United States Patent [19]

Cobb, III et al.

[11] Patent Number: 4,787,524

[45] Date of Patent: Nov. 29, 1988

[54] OVERLOAD PROTECTION SYSTEM FOR A CRANE

[75] Inventors: Jasper E. Cobb, III; William A. Bezner, both of Gainesville, Tex.

[73] Assignee: National-Oilwell, Houston, Tex.

[21] Appl. No.: 780,007

[22] Filed: Sep. 25, 1985

[51] Int. Cl.[4] ..... B66C 13/18

[52] U.S. Cl. ..... 212/150; 212/155; 212/262; 340/685

[58] Field of Search ..... 212/149, 150, 151, 152, 212/191, 155, 239, 155, 262, 153, 154; 340/666, 685, 689; 242/117, 125.1

[56] References Cited

U.S. PATENT DOCUMENTS

| | | | |
|---|---|---|---|
| 1,437,987 | 12/1922 | Miller | 242/117 |
| 1,614,575 | 1/1927 | Siebs | 212/150 |
| 1,700,313 | 1/1929 | Greve | 242/117 |
| 1,763,078 | 6/1930 | Yougken | 242/117 |
| 2,846,162 | 8/1958 | Allin | 242/125.1 |
| 3,334,756 | 8/1967 | Whitmire | 212/151 |
| 3,604,744 | 9/1971 | Wright | 212/149 |
| 3,771,667 | 11/1973 | Becker et al. | 212/155 |
| 4,354,608 | 10/1982 | Wudtke | 212/191 |
| 4,411,368 | 10/1983 | Manjot | 212/149 |

FOREIGN PATENT DOCUMENTS

| | | | |
|---|---|---|---|
| 368178 | 1/1973 | U.S.S.R. | 212/150 |
| 610774 | 6/1978 | U.S.S.R. | 212/149 |
| 1545495 | 5/1979 | United Kingdom | 212/149 |

*Primary Examiner*—Sherman D. Basinger
*Assistant Examiner*—Thomas J. Brahan
*Attorney, Agent, or Firm*—Frost & Jacobs

[57] ABSTRACT

An adaptive multi-stage overload protection system for a crane provides an optimal response dependent upon the magnitude of the crane overload. The control system permits the crane operator to take remedial action for overloads of relatively low magnitude, but automatically reponds to dangerous overload conditions. Under extreme conditions, the hoist line is permitted topay out, but only if less drastic responses have not adequately or timely corrected the overload condition.

15 Claims, 5 Drawing Sheets

OVERLOAD PROTECTION SYSTEM FOR A CRANE

TECHNICAL FIELD

The invention relates generally to cranes and more particularly to a control and release system for protecting a crane in response to overload conditions. The invention will be specifically disclosed in connection with an adaptive multi-stage control system which provides a variety of different responses in accordance to the magnitude of the overload and which permits the hoist line to pay out and separate from the hoist drum in response to an overload exceeding a predetermined danger level.

BACKGROUND OF THE INVENTION

Cranes are in widespread industrial and commercial use throughout the world for lifting heavy objects. In many applications, it is not uncommon to subject cranes to overload conditions. An overloaded condition may develop relatively slowly over time, or it may occur suddenly and erratically. For example, if a pedestal crane at an offshore oil drilling station is used to unload heavy objects from a floating ship onto a platform of the offshore drilling station, the weight of a lifted object supported by the ship may be rapidly shifted to the crane as a result of sudden vertical movements of the ship during high sea conditions. The impact resulting from such a rapid load transfer may exceed the capacity of the crane and cause damage to either the crane or the lifted object. If the overload on the crane is severe, it may result in the collapse of the crane boom or in injury to the crane operator.

A more slowly developing crane overload condition may result from attempting to lift a heavy load with the boom at a shallow angle to the horizon. Since the load on the crane is a function of the moment or torque produced on the crane by the lifted object, the crane operator may readily reduce such a crane overload by increasing the angle of the boom to shorten the horizontal distance between the lifted object and the pivotal axis of the boom at the base of the crane.

There have been several attempts in the prior art to provide overload detection systems to protect cranes from overload conditions. In the simplest of these systems, a signal is generated in response to a detected overload to merely alert the crane operator. The operator must then take remedial action to reduce the load. Other systems simply interrupt the hoisting system in response to detected overload conditions.

The above described systems are incapable of responding to sudden, erratic and severe overload conditions. In recognition of such shortcomings, an overload protection system with a much more drastic and automatic response is disclosed in U.S. Pat. No. 4,107,798 to Comyns-Carr. In the Comyns-Carr system, the hoist cable of a crane is automatically paid out in reponse to a predetermined overload condition. The hoist cable is connected to the hoist drum by a tail cable of low tensile strength, which tail cable breaks under overload conditions to permit complete separation of the hoist cable from the hoist and boom. Releasing the hoist cable from the boom in this manner satisfactorily protects the crane from damage. However, such drastic action also permits the heavy object which caused the overload condition to drop uncontrollably. As a result, the object may either be damaged or lost in the sea. Furthermore, the dropped object may further damage the ship or cause injury to persons on the ship.

The optimum response to a particular overload condition is in large part dependent upon both the severity of the overload and the speed with which the overload condition is developing. Many of the less severe or slowly developing overload situations are optimumly corrected by remedial action on the part of the crane operator. If alerted, the operator can eliminate many of these predictable types of overload situations with simple remedial action, without any adverse consequences whatsoever. Other overload situations, however, are so unpredictable and develop with such speed that it is more desirable to automatically respond with a predetermined action initiated by a control system independently of operator action. Even for slowly developing and predictable overload conditions it is desirable for the control system to automatically intervene in the event that the operator does not take timely or appropriate remedial action.

The overload protection systems of the prior art have not adaptively distinguished between different types of overload situations and have provided only a single response to any overload exceeding a predetermined minimum threshold magnitude. It is generally desirable to avoid over responding to a crane overload condition and to react to an overload condition with the least severe responsive action necessary to adequately correct the problem. Nevertheless, it is desirable to have some provision for protecting the crane from severe overloads. More particularly, it is desirable to release the hoist cable from the hoist drum and to permit the hoist cable to pay out freely under extreme overload conditions. Given the limitations of the overload protection systems of the prior art, users have been relegated to balancing the adverse consequences of over-responding upon overload conditions to the dangers of under responding.

SUMMARY OF THE INVENTION

Accordingly, it is a primary object of the invention to provide an adaptive crane control and release system for effectuating a variety of different optimal responses dependent upon specific overload conditions.

It is a more specific object of the invention to provide a control system having a series of progressive responses which release the hoist line from the hoist winch to permit the hoist line to pay out only under extreme overload conditions or when less drastic responses are unsuccessful.

Another object of the invention is to provide an efficient interconnection between a crane hoist line and a hoist winch drum which permits the hoist line to controllably release from the drum during pay out of the hoist line and, after all line is paid out, to freely release from the drum.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a multistage system is provided for protecting a crane against overload conditions. The crane includes a structural frame having an elongated boom. The boom has an inboard end pivotally secured to the structural frame about a substantially horizontal axis and an outboard end adapted for guiding a hoist line reeved about the outboard boom end. Means are provided for selectively retracting and extending a hoist line reeved about the outboard end of the boom to raise and lower a load supported thereby. The system is responsive to a load on the hoist line for generating a plurality of different control signals which are adaptively variable upon the magnitude of a load. The system is responsive to the signal generating means for effectuating a different crane operation in response to each of the different generated signals.

The protection system of the invention preferably includes mean for attenuating and dampening transitory loads on the hoist line.

In accordance with another aspect of the invention, each output of the signal generating means is responsive to a different predetermined load.

Most preferably, the signal generating means generates first, second and third control signals respectively responsive to first, second and third predetermined loads of progressively increasing magnitude.

According to a further aspect of the invention, the signal generating means includes a fluid actuator having an internally disposed movable member and a pressurized fluid disposed within the actuator for biasing the movable member toward a first predetermined position. Means for interconnecting the outboard end of the boom in the frame are also provided which are operative to urge the movable member against the bias of the pressurized fluid with a force proportional to the magnitude of a load supported by the hoist line.

In one specific aspect of the invention, the movable member is a piston and the fluid actuator includes a cylinder. The piston is movable within the cylinder in response to a predetermined force transmitted by the interconnecting means.

According to another specific aspect of the invention, the signal generating means includes a cam movable with the piston. The cam is selectively operable to open and close a plurality of switches in accordance with the position of the piston.

In a still further and specific aspect of the invention, a sleeve is provided for defining a movement path for the cam. The sleeve has a plurality of circumferential openings and the switch is partially extended into the circumferential openings into the movement path of the cam.

In accordance to yet another aspect of the invention, the signal generating means produces a first control signal in response to a first predetermined extension of the piston from the cylinder. The first control signal is operative to prohibit lowering of the boom and provides a signal, both visual and audible, to the crane operator.

According to a still further aspect of the invention, the signal generating means produces a second control signal in response to a second predetermined extension of the piston from the cylinder. The second control signal is operative to limit the torque sustainable by the hoist line.

In yet another aspect of the invention, the signal generating means produces a third control signal in response to a third predetermined extension of the piston from the cylinder. The third control signal is operative to depressurize a hoist motor used for extending and retracting the hoist line for permitting the hoist line to pay out.

In another aspect of the invention, an overload protection system for a crane includes a structural frame with an elongated boom pivotally secured thereto about one end. A hoist line is reeved about the opposite end of the boom for supporting a load. A winch is used for selectively retrieving and extending the hoist line to raise and lower a load supported by the hoist line. The winch has a generally cylindrical body with radially extending side walls at opposite axial ends of the body. The winch is rotatable about the primary axis of the cylinder body for retracting and extending the hoist line. At least one of the side walls has an obliquely oriented opening for receiving an end of the hoist line. Means are also provided for applying a torque to the winch and preventing rotation of the winch from the force produced by a load on the hoist line. The torque applying means is deactivated in response to a predetermined load on the boom hoist line.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects, all without the party who formed the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
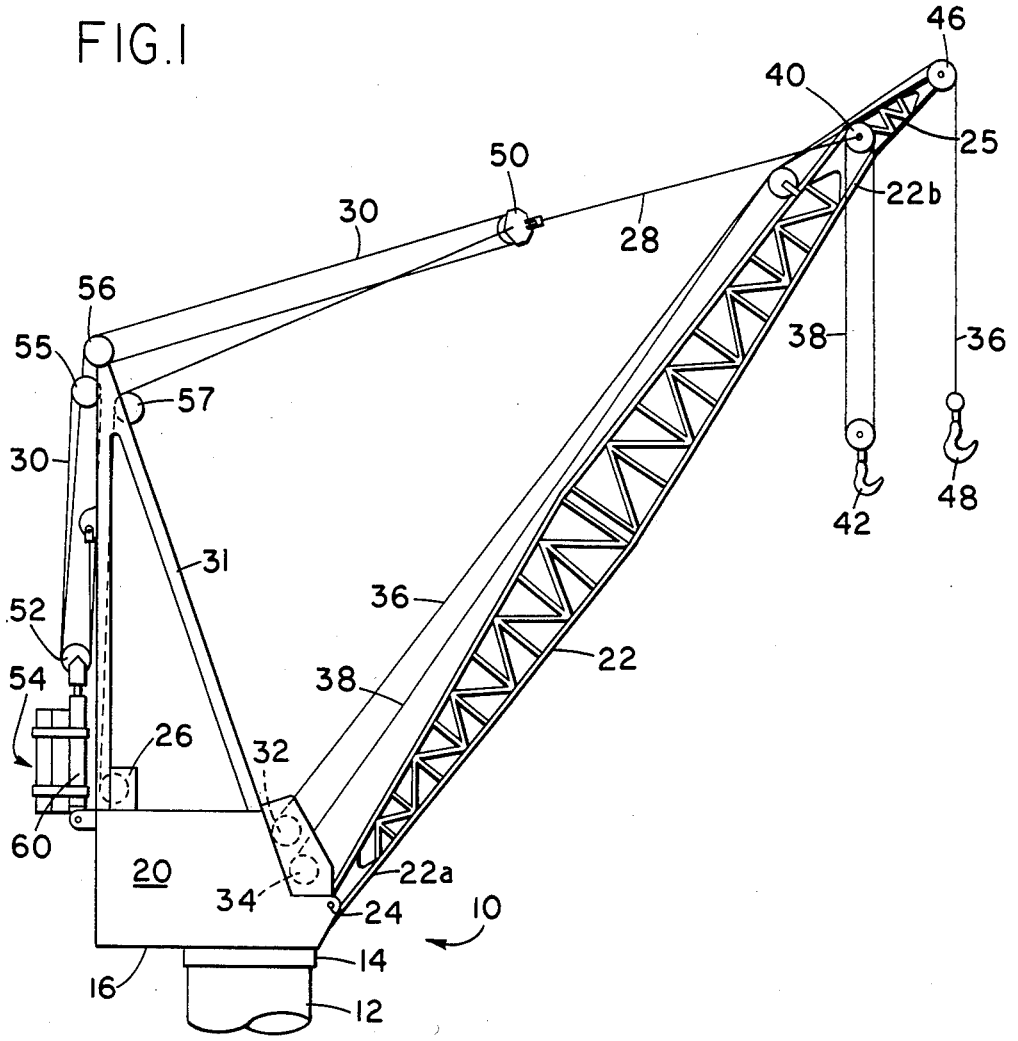
FIG. 1 is a somewhat schematic view of a crane using an overload protection system constructed in accordance with the principles of the present invention.

Referring now to the drawings, and to FIG. 1 in particular, a pedestal crane having an overload protection system constructed in accordance with the principles of the present invention is generally designated by the numeral 10. The crane 10 includes a pedestal base 12 of generally columnar configuration. A swing bearing 14 is secured to the top end of the pedestal 12 for supporting a rotatable structural frame 16. Although not specifically illustrated in FIG. 1, it will be appreciated by those skilled in the art that the swing bearing 14 includes a pair of races which are relatively rotatable with respect to each other. One of these bearing races is fixedly secured to the top of the pedestal base 12 with the other bearing race being secured to the structural frame 16, which frame 16 is rotatable about a vertical axis coincident with the axial center of pedestal base 12. As illustrated, the structural frame 16 includes a cab structure 20 for housing the crane controls and for locating an operator seat (not shown).

An elongated lattice type boom 22 is pivotally secured at its inboard end **22*a* to the frame 16 about an horizontal axis 24. A jib 25 is fixedly secured to and angularly extends from the opposite or outboard end 22*b* of the boom 22. Pivotal movement of the boom 22, and the attached jib 25, about the horizontal axis 24 is effectuated by a boom hoist winch 26 which is interconnected to one end of a pennant line 28 through a boom hoist line 30. The boom hoist line 30 is connected at one end to the boom hoist winch 26 and at the opposite end to a gantry superstructure 31, the gantry superstructure 31 having a triangular configuration in the illustrated embodiment and being supported on top of the cab structure 20. The intermediate portions of the boom hoist line 30 are reeved through a first movable pulley 50 connected directly to the pennant line 28. A second movable pulley 52 is secured to an overload detection assembly 54, and a series of fixed pulleys 55–57 rotatably mounted to the rear side of the gantry superstructure 31. The opposite end of the pennant line 28 is connected to the outboard end 22*b* of the boom 22. As will be immediately apparent to those skilled in the art, the boom hoist winch 26 is rotated under the impetus of a hydraulic motor 160 not shown in FIG. 1, see FIGS. 3 and 4) to raise and lower the boom 22 about the pivotal axis 34. In the illustration of FIG. 1, the boom hoist winch 26 is mounted on top of the cab 20, within the gantry superstructure 31**.

The structural frame 16 further supports a pair of winches 32 and 34 shown in proximity to the horizontal axis 24 in FIG. 1. The winches 32 and 34 are used to extend and retract whip and main hoist line cables 36 and 38 respectively. The main hoist cable 38 extends from the main line winch 34 about a pulley 40 rotatably attached to the outboard end **22*b* of boom 22. A main hoist hook 42 is hangingly supported about the end of the main hoist line 38, opposite the winch 34, by a multifall reeving system. Similarly, the whip hoist line 36 extends about a pulley 46 rotatably disposed at the outward extremity of jib 25 to hangingly support a whip hook 48. The winches 32 and 34 are, of course, rotated in a well-known manner to raise and lower the respective hooks 42,48 for lifting and lowering heavy objects to which the hooks, 42,48** are attached.

Figure 2:
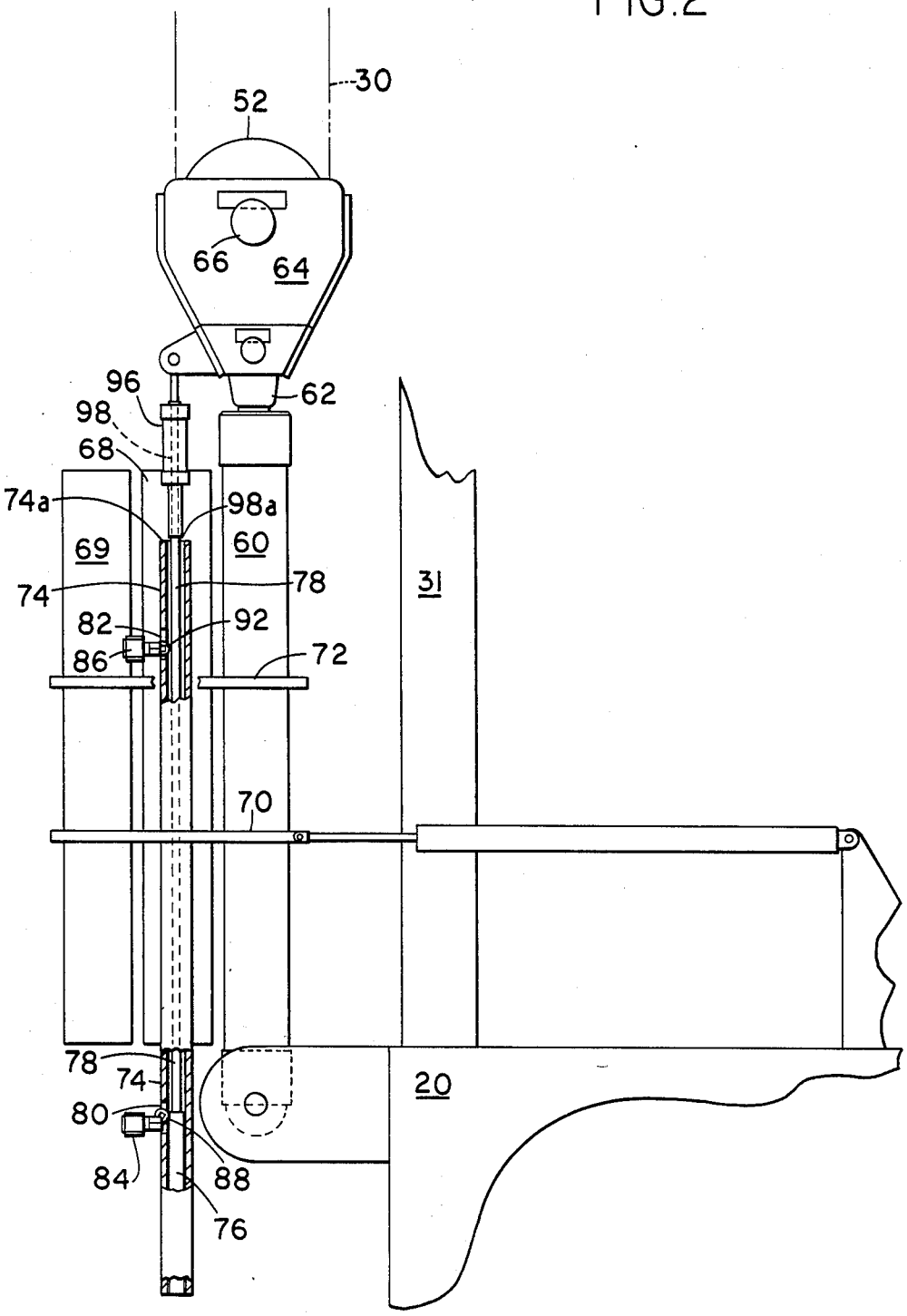
FIG. 2 is an enlarged view of the overload detection assembly mounted on the rear of a gantry superstructure shown in FIG. 1.

The overload detection assembly 54 of FIG. 1 is shown in greater detail in FIG. 2. As illustrated, the assembly 54 includes a cylinder 60 having a reciprocally movable piston 62 disposed therein. The outboard end of the piston 62 is connected to a pulley bracket 64, which bracket 64 rotatably supports the movable pulley 52 about a pin 66. A first or primary accumulator cylinder 68 is secured to the top of the cylinder 60. This accumulator cylinder 68 is interposed between the cylinder 60 and a second or residual accumulator cylinder 69 by a pair of brackets 70 and 72. A cam sleeve 74 fixedly supported on the first accumulator cylinder 68 is also disposed within the outside of the brackets 70 and 72. The cam sleeve 74 is elongated and has a cylindrically shaped cam 76 slidably movable therein. A control rod 78 is rigidly attached at one end to the cam 76 and at the other end to the pulley bracket 64 to move the cam 76 within the cam sleeve 74 in accordance with movement of the pulley bracket 64.

The illustrated cam sleeve 74 has a pair of longitudinally spaced circumferential openings 80 and 82. A corresponding pair of cam biased monostable valves 84 and 86 are also positioned on the periphery of the first accumulator cylinder 68 to partially extend to the respective cam sleeve openings 80 and 82. In the illustrated embodiment, the cam biased switch 84 includes a roller 88 rotatably supported on a pivotal link. The roller 88 extends into the first opening 80 and is selectively engaged by the cam 76 as the cam 76 is slidably moved in sleeve 74 past the circumferential opening 80. For purposes which will be explained below, the cam 76 is used to pivot the link of roller 88 to cause switch 84 to generate a control signal.

Similarly, the second cam biased switch 86 includes a roller 92 which extends into the circumferential cam sleeve opening 82. The roller 92 is rotatably supported on a pivotal link, which link is selectively pivoted under the interface force of the cam 76 whenever the cam 76 is moved into engagement with the roller 92. When this link is so pivoted, the switch 86 generates a further control signal for control of the crane 10.

FIG. 2 further shows that the control rod 78 also extends through a hollow piston-cylinder arrangement having a cylinder 96 and a piston 98. The piston cylinder arrangement 96,98 is positioned with the outboard end **98*a* of the piston in axial end-to-end relationship with the end 74*a* of cam sleeve 74. As the cam continues to travel in the sleeve 74 (to the right in FIG. 1), the cam 76 engages the axial piston end 98*a* and compressingly forces the piston 98 into the cylinder 96 to generate a still further control signal for the crane 10**.

When an overload condition occurs, the load will be applied against the boom 22 to urge the boom 22 in a clockwise direction in the illustration of FIG. 1. This clockwise urging of the boom 22 is opposed by the pennant line 28, which in turn, transmits a tensile force against the pulley 50 and the hoist line 30 reeved thereto. The boom hoist line 30 then urges the piston 62 out of cylinder 60 with a force dependent upon the load of the crane 10.

Figure 3:
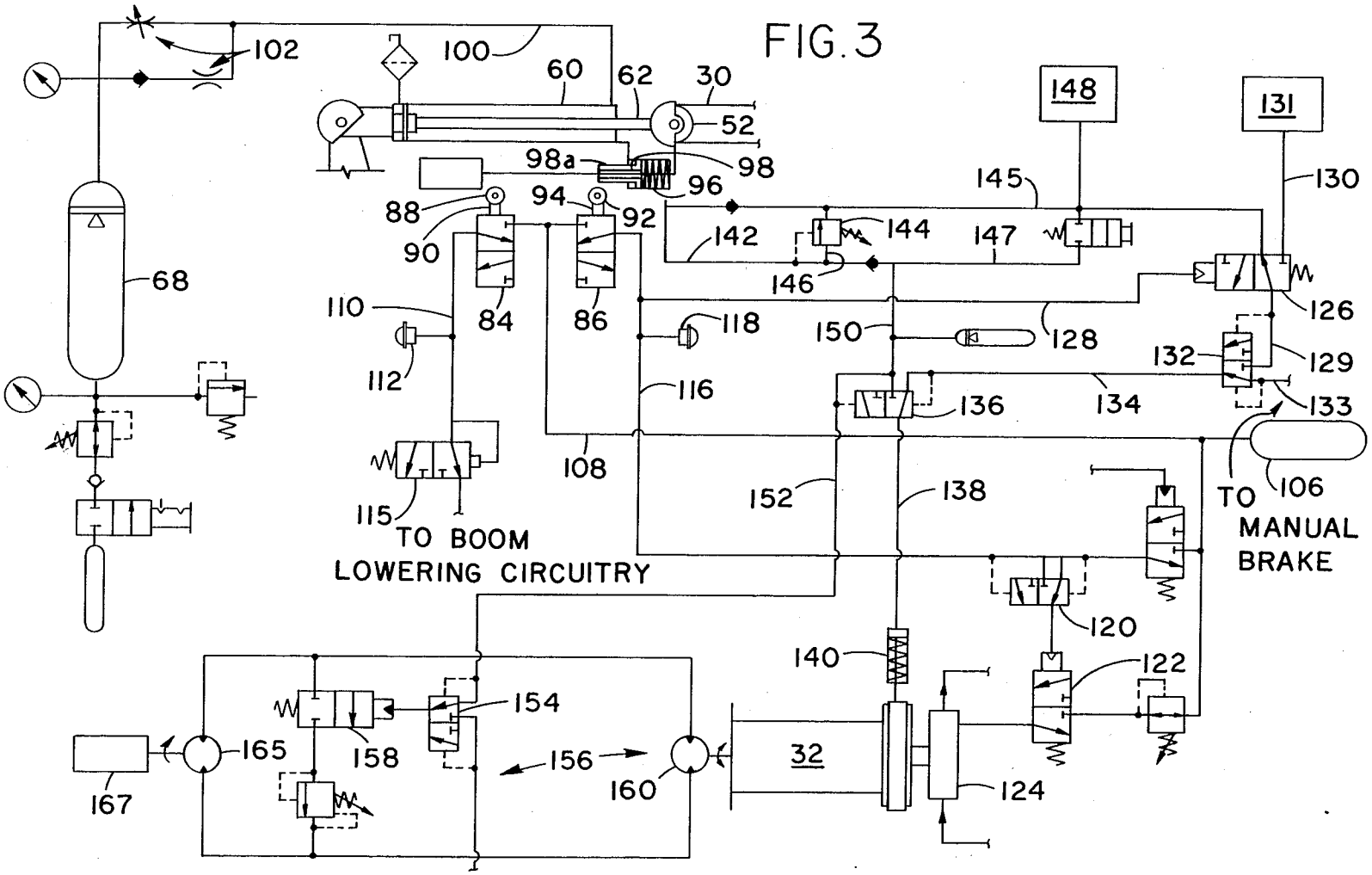
FIG. 3 is a schematic representation of a control system used in the embodiments of FIGS. 1 and 2.

The overall control scheme of the overload protection system of the preferred embodiment is best realized from viewing the schematic representation of FIG. 3. From that schematic view, it will be appreciated that the movement of the piston 62 out of the cylinder 60 is resisted by a pressurized fluid in the primary accumulator cylinder 68. This pressurized fluid is directed into the cylinder 60 through a passageway represented by a hydraulic line 100 in the illustration. The rate of flow of this fluid is variably regulated by a tuning control 102 disposed in the line 100. The magnitude of the pressure of this fluid determines the magnitude of load on crane 10 required to move the piston 62 and activate the overload detection assembly 54. Preferably, a compressible fluid, such as nitrogen, is used in the accumulator 68 to dampen and attenuate impactive and other transitory forces on the boom 22.

Applicant has found that the magnitude of the pressurized fluid in cylinder 60 is advantageously selected to require a first predetermined load well within the range of the calculated safe working load for crane 10, to initiate movement of the piston 62 within the cylinder 60. This first predetermined level may be selected as a percentage of the calculated safe working load. The preferred embodiment, for example, has a first predetermined level of approximately 65–85% of the calculated safe working load. With this level of fluid pressure, the piston 62 will remain substantially fully retracted in the cylinder 60 for any load which does not exceed the aforementioned level of the first predetermined load.

Since the movement of piston 62 against the control fluid in cylinder 60 further compresses the control fluid, continued movement of the piston 62 requires a progressively greater force. As illustrated in FIG. 3, some movement of the piston 62 is permitted before the overload detection assembly 54 generates any control signal. This permits attenuation and dampening of relative low level impactive and transitory forces. Once the load reaches a second predetermined magnitude, the cam 76, which moves with the piston 62, engages the roller 88 to pivot the link 90 of the first control switch 84. The switch 84 then directs pressurized air from a compressed air source 106 along lines 108 and 110 to energize a caution light 112. This caution light 112 is located within the cab structure 20 to alert the operator of an overload exceeding the second predetermined level. In the preferred embodiment, this second predetermined level is selected to correspond to a magnitude slightly less than the crane's safe working load, as for example 85–90% of the safe working load.

The air passage 110 is also in communication with a switch 115 in the boom lowering function circuitry and the pressurized fluid is operative to interrupt this function without any possibility of override. Hence, once the load detection assembly 54 indicates a crane load exceeding the second predetermined level, the operator will be precluded from increasing the load by lowering the boom. Any other remedial action by the operator is permitted at this load level.

However, if the load on the boom hoist line 30 of the preferred embodiment exceeds a third predetermined level, the illustrated cam 76 will engage the roller 94 of the second monostable control switch 86 to pivot the link 94. This third predetermined level may be slightly above the safe working load, as for example 105–115% of the calculated safe working load. Pressurized air is then directed through line 108 to a further line 116. Pressurized air in the line 116 activates a second light 118 in the cab structure 20 and further functions to move a bistable switch 120 to a position wherein the pressurized air in line 116 is communicated to a monostable switch 122. The switch 122 is moved in response to this pressurized air to complete fluid communication between the air supply 106 and a torque limiting clutch 124. As will be explained in greater detail below, the torque limiting clutch 124 is operative to permit the hoist winch 32 to pay out under a light tension.

The pressurized air in line 116 is also applied to another monostable switch 126 through a line 128. The switch 126 is moved in response to the pressure to connect a line 130 with an auxiliary pressure supply 131. Pressurized fluid in the line 130 is then communicated to a line 129 and moves a bistable switch 132 to connect line 130 and a line 134 and to disconnect line 134 from a line 133 pressurized in response to the application of a manual brake by the operator. Pressure in line 134 also ensures that a bistable switch 136 is in a position to provide communication between line 134 and a line 138. This applies the auxiliary supply pressure 131 to a spring set hoist brake cylinder 140 to release the brake for hoist winch 32 without the possibility of an operator override. Hence, the hoist winch 32 is permitted to pay out under light tension.

If permitting the hoist winch to pay out under light tension does not alleviate the overload condition, and the piston 62 continues to retract within cylinder 60, the control system of the preferred embodiment responds even further. More specifically, the cam 76 will engage the piston end **98*a* to force piston 98 into cylinder 96. This action generates a hydraulic signal along line 142 to move a monostable switch 144 disposed in a line 146 to a position which completes fluid communication between lines 145 and 147 across line 146. Hydraulic fluid from a tank 148 is then applied through lines 150 and 152 to a bistable switch 154 located in a hydraulic control circuit generally designated by the numeral 156. The switch 154 is moved in response to pressure in line 152 to activate a monostable switch 158 and to short circuit a hoist motor 160 from the hydraulic circuit 156. With the circuit 156 short circuited in this manner the hoist motor 160 will be depressurized to allow the hoist line 32 to pay out at the maximum line speed of the winch 32. Hydraulic pressure in the circuit 156 is supplied by a hoist pump 165 moved by a prime mover 167. Hydraulic pressure in line 152 also urges the bistable switch 136 to a position establishing communication between lines 150 and 138 to apply the hydraulic pressure to the hoist brake cylinder 140** to prevent engagement of the hoist winch brake.

It is thus seen that the disclosed control system provides a plurality of different responses depending upon the magnitude and duration of the overload on the crane 10. If the overload is only transitory and of relatively low magnitude, it may be merely dampened by compression of the fluid within cylinder 60. If the overload exceeds the second predetermined percentage of the safe working load for crane 10, caution light 112 located within the cab structure 20 will be energized to alert the operator. The operator may then take remedial action, such as raising the boom, to alleviate the overload condition. The boom lowering function will also be overridden to prevent the operator from further lowering of the boom. If the overload exceeds the third predetermined percentage of safe working load, the hoist brake cylinder 140 will be deactivated to prevent the operator from setting the brake if the hoist control is returned to neutral. Additionally, the torque limiting clutch 124 is activated to limit the torque applied to the winch 32. This permits the hoist line 36 to pay out at a light tension.

If for any reason the overload continues, and piston 62 continues to retract in cylinder 60, piston 98 will be extended into cylinder 96 to depressurize the hoist motor 160 to allow the hoist line 36 to pay out at maximum line speed.

Figure 4:
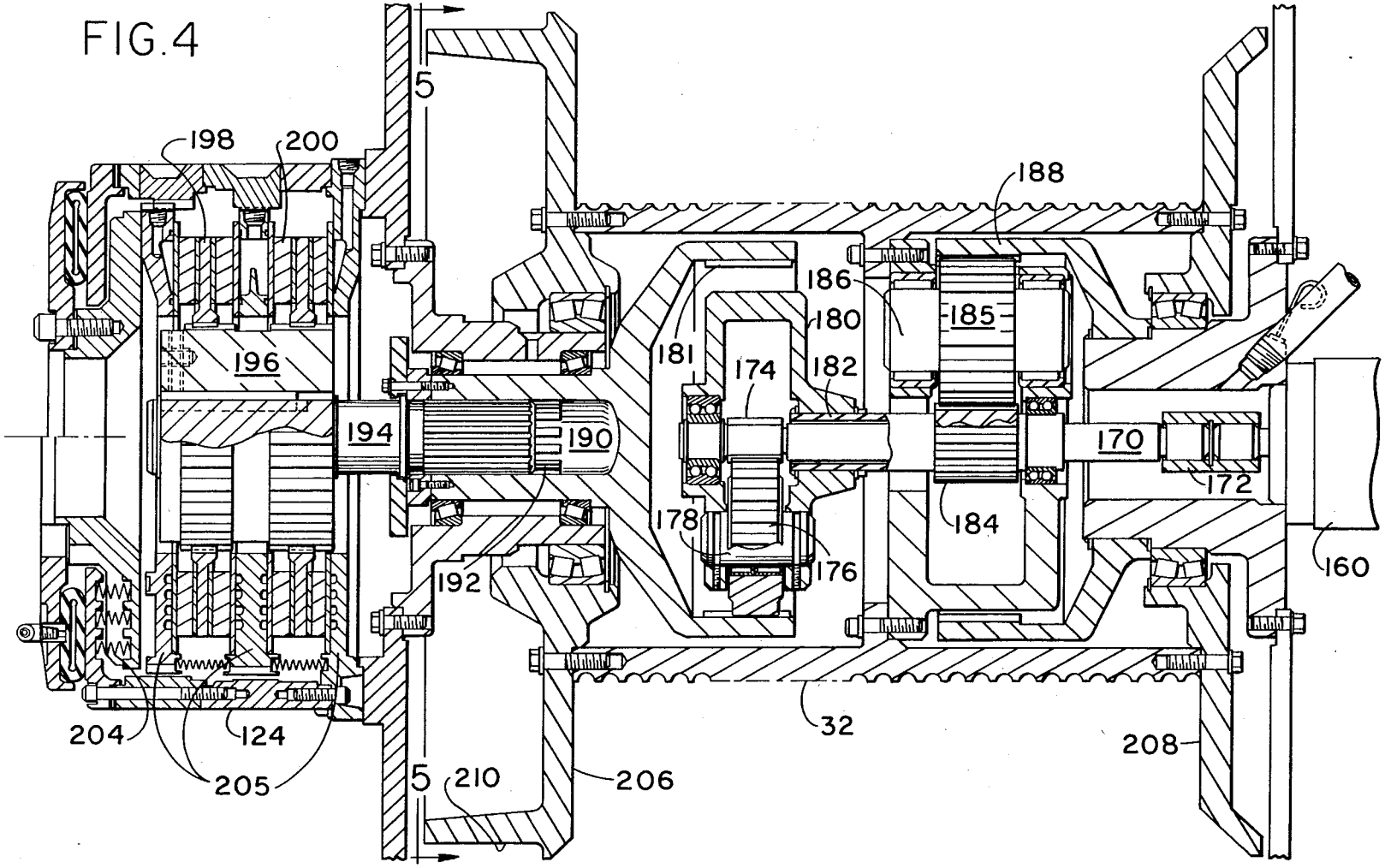
FIG. 4 is a cross-sectional view of a hoist winch and torque limiting clutch used on the crane of FIG. 1.

The details of the hoist winch 32 and torque limiting clutch 124 are shown in FIG. 4. The output of hydraulic motor 160 is coupled to a winch drive shaft 170 through an input coupling 172. A first pinion 174 is splined to the opposite end of the winch drive shaft 170, the pinion 174 also being in meshing relationship with a gear 176 rotatably journaled about a shaft 178. The shaft 178 is fixed in a first planet carrier drive 180 which is selectively rotatable about the axis of winch drive shaft 170. The gear 176 is further meshed with the internally disposed teeth of a ring gear 181. If the ring gear 181 is held in a stationary position, rotation of the gear 176 will cause the carrier drive 180 to rotate about drive axis 170.

The carrier drive 180 is splined to a hollow shaft 182 concentrically disposed about the drive shaft 170. A second pinion 184 is splined to the exterior of the hollow shaft 182 for driving a gear 185 supported on a shaft 186. The shaft 186 is held to the hoist drum 32 by a plurality of fasteners specifically illustrated as screws. The gear 185 is also meshed with the internal teeth of a stationary ring gear 188. Rotation of the gear 185 will rotate the shaft 186, as well as the hoist drum 32 to which it is fixedly connected about the axis of drive shaft 170.

From the above, it will be apparent that the hoist drum 32 will be rotated by the hydraulic motor 160 only when the ring gear 181 is held in a stationary position. The axial end ring gear 181 opposite the carrier drive 180 has a bore 190 concentrically spaced about the drive axis 170. This bore 190 has a plurality of spaced splines 192 which cooperate with a series of complementary splines on a shaft 194 which interconnects the ring gear 181 with the torque limiting clutch 124. A center plate 196 is splined to the opposite end of shaft 194 and includes a plurality of radially extending friction fingers 198, each of which supports a pair of friction pucks 200. These friction pucks 200 are compressingly engaged in interposed relationship between a series of radially inwardly extending wear plates 205 rigidly secured to the housing of clutch 124. A plurality of compression springs 204 are used to adjustably vary the compressive force between the pucks 200 and the wear plates 205. The frictional engagement between the pucks 200 and friction fingers 198 will prevent rotation of the center plate 196, and thus the ring gear 181 if the torque does not exceed a predetermined magnitude.

It will further be noted from the illustration of FIG. 4 that the winch drum has a generally cylindrical body enclosed between a pair of radially extending side walls 206 and 208. An axially extending brake drum 210 is secured to the radial outermost portion of the side wall 206. This brake drum and the side wall 206 is shown in greater detail in FIGS. 5 and 6.

Figure 6:
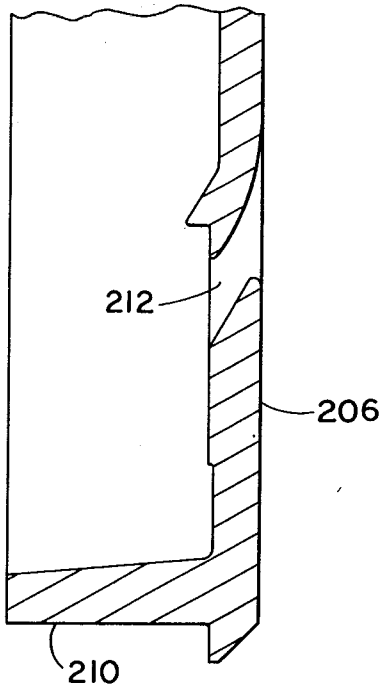
FIG. 6 is a cross-sectional view taken along line 6—6 in FIG. 5 depicting an obliquely oriented opening extending through the winch side wall for receiving an end of the hoist line.
Figure 5:
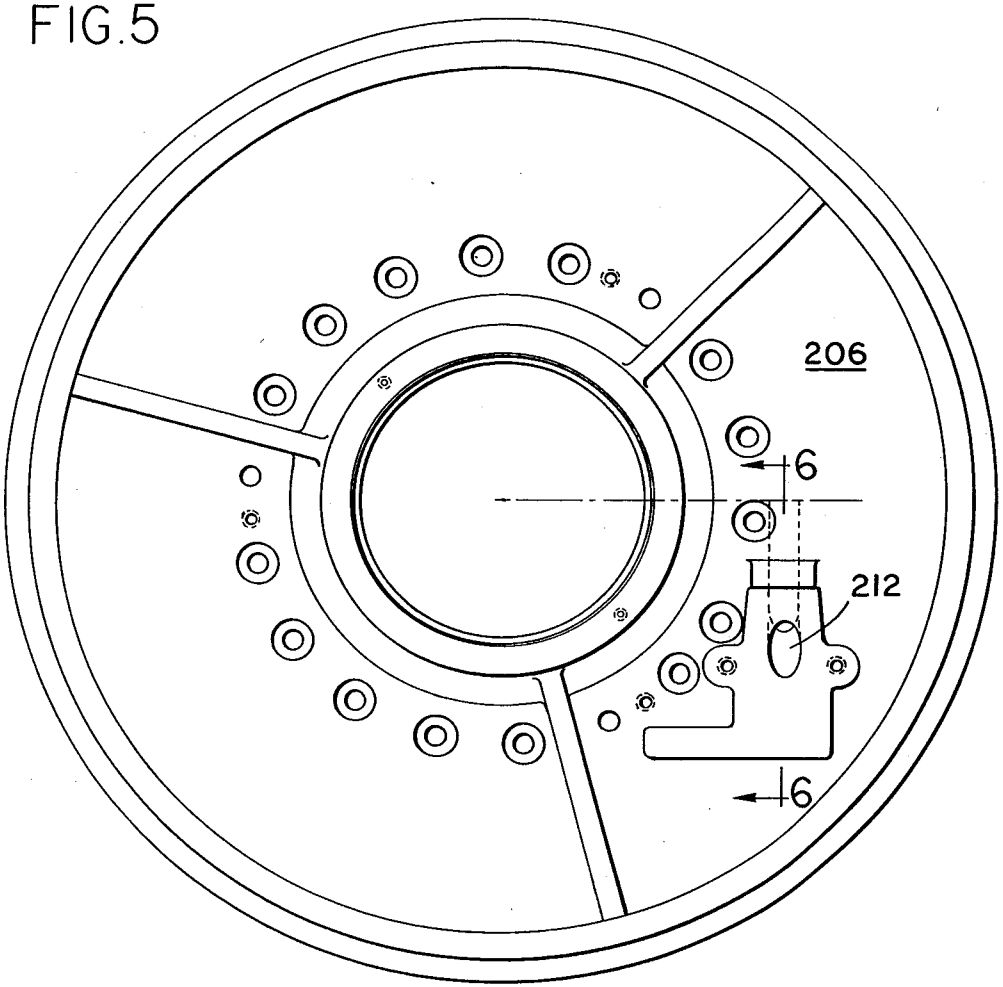
FIG. 5 is a side elevational view of the winch side wall and brake drum of the winch of FIG. 4.

From FIGS. 5 and 6 it will be noted that the side wall 206 has an obliquely oriented opening 212 extending therethrough. In use, the bitter end of boom hoist line 30 is passed through this obliquely oriented aperture 212 and positioned in the space defined by the brake drum 210 prior to rolling the hoist line 30 about the drum 32. In the event that the hoist line 30 should pay out, the end of the hoist line cable would merely be withdrawn from the aperture 212 and the cable would be permitted to completely separate from the drum 32. Significantly, anchoring the hoist line 30 in the obliquely oriented opening 212 does not require backward bending of the hoist line 30. Moreover, the oblique orientation of the opening 212 insures smooth, orderly and controlled withdrawal of the hoist line 30 from the winch 32 and reduces the possibility that the hoist line 30 will become entangled.

In summary, numerous benefits have been described which result from employing the concepts of the present invention. The invention provides a control system which adaptively provides a plurality of different crane responses to overload conditions of varying magnitude and duration. Applicants' adaptive control system permits the crane operator to take remedial action for overloads of relatively low magnitude, but automatically provides an optimum response to overloads which approach dangerous levels. The most drastic of the control responses, permitting free pay out of the hoist line, is initiated only after less drastic responses have not adequately or timely corrected the overload condition. The use of the obliquely oriented opening in the winch side wall avoids backward bending of the hoist line and permits the hoist line to release from the winch drum in a controlled fashion which does not cause entanglements of the hoist line.

The foregoing description of a perferred embodiment of the invention has been presented for purposes of illustration and description. It is not intended to be exhaustive or to limit the invention to the precise form disclosed. Obvious modifications or variations are possible in light of the above teachings. The embodiment that was chosen and described in order to best illustrate the principles of the invention and its practical application to thereby enable one of ordinary skill in the art to best utilize the invention in various embodiments and with various modifications as are suitable to the particular use contemplated. It is intended that the scope of the invention be defined by the claims appended hereto.

What is claimed is:

1. A multi-stage system for protecting a crane against overload, comprising:

(a) a structural frame;

(b) an elongated boom, said boom having an inboard end pivotally secured with respect to the structural frame about a substantially horizontal axis and an outboard end adapted for guiding a load hoist line reeved thereabout, said boom being pivotally movable throughout a range of movement;

(c) a boom hoist line interconnected to the outboard end of said boom for pivoting said boom about said horizontal axis to raise and lower the outboard end of the boom;

(d) a load hoist line, said load hoist line reeved about the outboard end of the boom for supporting a load connected to the load hoist line;

(e) means for selectively retracting and extending the load hoist line to raise and lower a load supported by the load hoist line;

(f) means responsive to a load on said boom hoist line for generating a plurality of different control signals, which control signals are adaptively dependent upon the magnitude of the load on the boom hoist line throughout the range of boom movement; and (g) control means responsive to said signal generating means for adaptively providing multiple levels of corrective action to control both the boom hoist line and the load hoist line, said control means being operative to prevent lowering of the boom in response to a first control signal and operative to vary the magnitude of the load supported on the load hoist line in response to a second control signal.

2. A multi-stage protection system as recited in claim 1, wherein said signal generating means further includes means for attenuating transitory loads on said boom hoist line.

3. A multi-stage protection system as recited in claim 2, wherein said signal generating means further generates a third control signal.

4. A multi-stage protection system as recited in claim 1, wherein each output of said signal generating means is responsive to a different predetermined load on the boom hoist line.

5. A multi-stage protection system as recited in claim 1, wherein said signal generating means further includes a fluid actuator having an internally disposed movable member and a pressurized fluid disposed within said actuator for biasing said movable member toward a first predetermined position, said boom hoist line being operative to urge the movable member against the bias of the pressurized fluid with a force proportional to the magnitude of a load supported by the boom hoist line.

6. A multi-stage protection system as recited in claim 5, wherein said movable member is a piston and said fluid actuator includes a cylinder, the piston being movable within the cylinder in response to a predetermined force transmitted by the boom hoist line.

7. A multi-stage protection system as recited in claim 6, wherein said signal generating means includes a cam movable with said piston, said cam being selectively operable to open and close a plurality of switches in accordance with the position of the piston.

8. A multi-stage protection system as recited in claim 7, further including a sleeve for defining a movement path for the cam, said sleeve having a plurality of circumferential openings, the switches partially extending into the circumferential openings into the movement path of the cam.

9. A multi-stage protection system as recited in claim 1, wherein said signal generating means includes a piston reciprocally movable within a cylinder, said piston being urged to a retracted position in the cylinder by a pressurized fluid, said boom hoist line connected to the piston for applying a force to the piston to urge the piston against the pressurized fluid, the force on the piston being proportional to the load on the boom hoist line.

10. A multi-stage protection system as recited in claim 9, wherein said first control signal is generated in response to a first predetermined extension of said piston from said cylinder.

11. A multi-stage protection system as recited in claim 10, wherein said second control signal is generated in response to a second predetermined extension of said piston from said cylinder.

12. A multi-stage system as recited in claim 11, wherein said signal generating means produces a third control signal in response to a third predetermined extension of said piston from said cylinder.

13. A multi-stage protection system as recited in claim 1, further including a hoist winch having a generally cylindrical body disposed between a pair of axially spaced side walls, one of said side walls having an obliquely oriented opening for receiving one end of said load hoist line.

14. A multi-stage protection system as recited in claim 1, further including a hoist motor for extending and retracting a load hoist line, said control means being operative to depressurize the hoist motor in response to the second control signal.

15. A multi-stage protection system as recited in claim 1, wherein said control means include a hoist motor for extending and retracting the load hoist line and wherein the magnitude of the load supported on the load hoist line is decreased by depressurizing the hoist motor.

* * * * *